US007040456B2

(12) United States Patent
Ach et al.

(10) Patent No.: US 7,040,456 B2
(45) Date of Patent: May 9, 2006

(54) ELEVATOR CAR DRIVE AND SUPPORT BELT HAVING A TWISTED ORIENTATION

(75) Inventors: Ernst Ach, Ebikon (CH); Erich Bütler, Ebikon (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 10/999,584

(22) Filed: Nov. 30, 2004

(65) Prior Publication Data

US 2005/0115799 A1 Jun. 2, 2005

(30) Foreign Application Priority Data

Dec. 1, 2003 (EP) ..... 03405853

(51) Int. Cl.
*B66B 11/08* (2006.01)

(52) U.S. Cl. ..... 187/251; 187/254; 187/260; 474/62; 474/205; 474/260; 474/263; 474/265; 74/89.2; 74/490.04; 242/540; 198/790; 198/835; 198/844.1

(58) Field of Classification Search ..... 187/251, 187/254, 264; 474/62, 66, 139, 149, 167, 474/188, 205, 260–5; 492/30, 38, 48; 74/89.2, 74/490; 180/366, 357; 198/839, 790, 835; 242/540; 254/265
See application file for complete search history.

(56) References Cited

U.S. PATENT DOCUMENTS

| | | | | |
|---|---|---|---|---|
| 2,522,148 | A * | 9/1950 | Traxler | 474/62 |
| 3,083,583 | A * | 4/1963 | Reinhold | 474/153 |
| 3,365,966 | A * | 1/1968 | Heyer | 474/62 |
| 3,911,755 | A | 10/1975 | Vance, Sr. | |
| 4,449,958 | A * | 5/1984 | Conrad | 474/205 |
| 5,191,920 | A * | 3/1993 | McGregor | 141/313 |
| 5,429,211 | A * | 7/1995 | Aulanko et al. | 187/254 |
| 2003/0121729 | A1 * | 7/2003 | Heinz et al. | 187/254 |

FOREIGN PATENT DOCUMENTS

| | | |
|---|---|---|
| EP | 1 353 087 | 10/2003 |
| EP | 1 396 458 | 3/2004 |
| WO | WO 2002053486 A1 * | 7/2002 |
| WO | WO 03/043922 | 5/2003 |
| WO | WO 2003043922 A1 * | 5/2003 |

* cited by examiner

*Primary Examiner*—Kathy Matecki
*Assistant Examiner*—Stefan Kruer
(74) *Attorney, Agent, or Firm*—Butzel Long

(57) ABSTRACT

An elevator system includes a roller arrangement and a belt for supporting an elevator car. The roller arrangement has two rollers with approximately parallel axes of rotation and structured circumferential surfaces engaging a complementary structured surface of the belt. The structured surfaces have alternating ribs and grooves. The belt is twisted about its longitudinal axis between the two rollers to keep the structured surfaces in contact and forms an under-looping for support of the elevator car.

15 Claims, 6 Drawing Sheets

ELEVATOR CAR DRIVE AND SUPPORT BELT HAVING A TWISTED ORIENTATION

BACKGROUND OF THE INVENTION

The present invention relates generally to an elevator system and, in particular, to a support belt for an elevator.

The present invention is particularly, but not exclusively, suitable for use in conjunction with an elevator system without a machine room. Such an elevator system without a machine room has the advantage that by comparison with conventional elevator systems with machine rooms it requires less space and, in particular, in the case of installation in flat-roof buildings it is not necessary to provide superstructures projecting above the roof.

A flat belt guided over several drive or deflecting rollers is shown in patent publication WO 03043922. The shaft space cannot be utilized in an optimum manner in every case with the depicted disposition. In particular, the profiled side of the belt cannot be used when bent in an opposite direction.

It is the object of the present invention to propose an improved elevator system that enables wider use of a belt profiled at one side.

SUMMARY OF THE INVENTION

According to the present invention, in a new elevator system the structured belt main surface is in engagement with the circumferential surface of the two rollers even when the first of the rollers rotates oppositely to the second of the rollers. This is achieved in that the section of the belt respectively disposed between the two rollers is twisted about its longitudinal center axis through a twist angle.

With this new belt guide it is achieved that the system of rollers and belt can exert, in an optimum manner, a driving function, a supporting function and a guiding function.

The angle of rotation about which the belt is twisted between two rollers running in different sense amounts in some forms of embodiment to approximately 180° when the axes of rotation of the two rollers are parallel and the rollers lie approximately in a common plane. There are also roller arrangements in which the axes of rotation of the two rollers are disposed approximately at right angles to one another. In this case the angle of rotation of the belt amounts to approximately 90°.

According to the present invention the angle of rotation of the belt is equal to the angle about which the aligned axes of rotation of the two rollers are twisted relative to one another. Moreover, the direction of rotation in which the belt is twisted is equal to the direction of rotation about which the axis of rotation of the first roller has to be rotated in order to align it parallel with the axis of rotation of the second roller.

According to the present invention the twist angle lies between 70° and 200°, and preferably between 80° and 110°, or between 160° and 200°.

A certain degree of loading of the respectively twisted region of the belt does, in fact, indeed arise in case of twisting of the belt. However, this loading is insignificant at least in the case of suitable construction of the belt.

Thereagainst, there is avoidance of the reverse bending loading, which would act on the belt if it was not twisted and therefore bent in alternation in different directions about transverse axes, which would be the case when, without being twisted, it would have to run around rollers not rotating in the same sense. The service life of a belt increases due to elimination of this reverse bending loading.

It is equally advantageous that the structured belt surface when running around the rollers is loaded substantially in compression and not, like the outer belt main surface, in tension. The belt is indeed disposed under bending stress in the region of the outer belt main surface when running around the rollers, but is always bent in such a manner that the outer belt main surface is remote from the roller and therefore experiences substantially a loading in tension. The belt region adjoining the structured belt surface thereagainst experiences merely a loading in compression.

A further advantage of the new arrangement is that the unstructured belt main surface is virtually unloaded by friction, since this unstructured belt main surface does not come into contact with circumferential surfaces of the rollers. The otherwise usual coating of the unstructured belt main surface can therefore be omitted without the service life of the belt being prejudiced.

It is also possible to use the unstructured belt main surface for other purposes, for example this belt main surface can be provided with a coating which changes in the case of loading and the respective aspect of which allows conclusions to be drawn about the respective deformation, temperature or speed of the belt.

In order to be able to exert a support function or act as support roller, a roller has to be looped around the belt by at least 45°.

In order to able to exert a drive function the drive pulley should be able to transmit to the belt a greatest possible drive force (traction force). For this purpose it is important that belt and rollers have a contact surface which amplifies the traction capability, for example by V-shaped ribs and grooves or by tooth-like transverse ribs and transverse grooves.

Moreover it is important that the belt is guided in correct lateral position around the rollers, which can be achieved by suitable interengaging complementary structures in the rollers and in the belt.

The belt ribs and belt grooves preferably extend parallel to the longitudinal axis of the belt and the complementary roller ribs and roller grooves correspondingly extend longitudinally of the roller circumference. The guidance characteristics between the rollers and the belt are thereby substantially improved. Moreover, transversely extending belt grooves can lead to a reduction in the bending stress in the belt.

The belt ribs and belt grooves can also extend transversely to the longitudinal axis of the support element and/or drive element and the roller ribs and roller grooves then correspondingly extend at least approximately in the direction of the axes of rotation of the rollers. The drive characteristics between the rollers and the belt are thereby substantially improved.

In the case of twisting of the belt according to the present invention, the deformation of the belt center region increases towards the belt edge regions. There is therefore preferably used a belt which has a lower elastic deformability in the belt middle region than in the belt edge regions. In this manner it is prevented that the belt edge regions in the case of twisting of the belt are subjected to unacceptably strong deformation.

It has proved favorable to provide the belt with reinforcing inserts extending predominantly in the direction of its longitudinal axis. Such reinforcing inserts can, for example, be arranged in stronger construction or in denser arrangement in the region of the longitudinal axis, whereby the belt is more readily deformable in the belt edge region than in the belt middle region.

Since the edge regions of the belt as a consequence of the twisting are exposed to increased longitudinal strain relative to the center regions, reinforcing inserts, the stress/strain ratio (modulus of elasticity) of which is correspondingly lower, can be provided in the belt edge regions. In the case of reinforcing inserts in the form of steel strands, this can be achieved by, for example, a different form of manufacture of the strands (for example, by twisting of different strength).

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
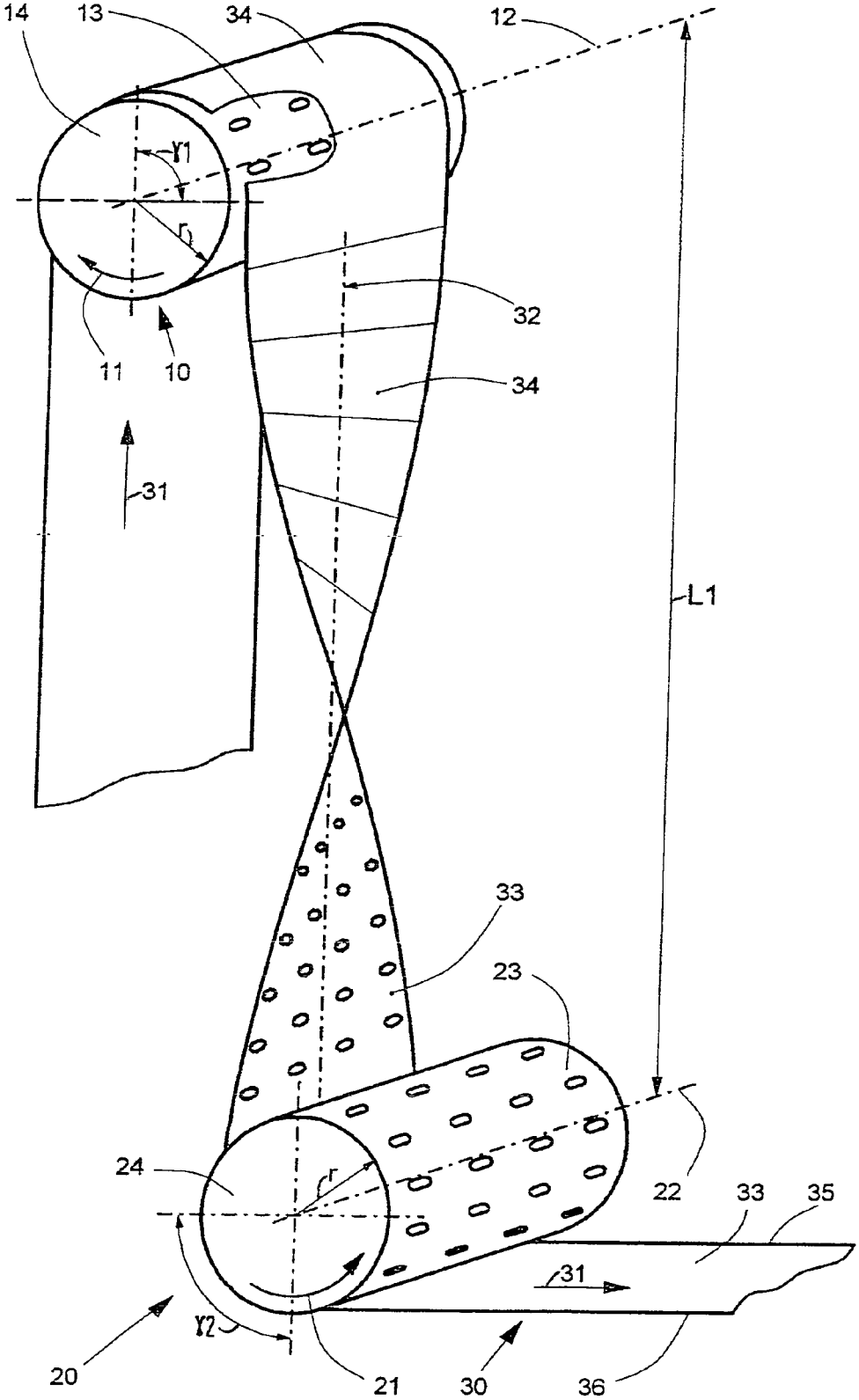
FIG. 1 is a schematic perspective view of an elevator belt arrangement according to the present invention with two rollers and a belt extending directly therebetween.

FIG. 1 shows an arrangement for an elevator system according to the present invention with a first roller 10, a second roller 20 and a belt 30, which forms a support element and/or drive element of the elevator system. The belt 30 couples, in terms of movement and in appropriate sequence, various elements (not illustrated) of the elevator installation, particularly an elevator car, a counterweight and a roller arrangement, of which only the rollers 10 and 20 are illustrated. The belt 30 runs, in the case of a specific direction of movement of the elevator car, from the first roller 10 directly to the second roller 20 or, in other words, the rollers 10 and 20 are, seen in the direction of movement of the belt 30, directly arranged in direct succession.

In case of movement of the elevator car, or in the case of movement of the belt 30 taking place with movement of the elevator car, the rollers 10 and 20 rotate in an opposite sense. If, for example, the belt 10 moves in the direction of an arrow 31, then the roller 10 rotates in the direction of an arrow 11 about a first axis 12 of rotation and the roller 20 rotates in the direction of an arrow 21 about a second axis 22 of rotation.

The rollers 10 and 20 are so arranged that the axes 12 and 22 of rotation extend at least approximately parallel to one another and that the belt 30 does not have to be displaced or hardly has to be displaced in the direction of the axes of rotation, but always remains between two parallel planes extending perpendicularly to the axes 12 and 22 of rotation. In the case of the arrangement illustrated in FIG. 1, forward end surfaces 14 and 24, of the rollers 10 and 20 respectively, lie in one plane (roller arrangement free of offset).

The roller 10 has a structured circumferential surface 13, wherein the structuring thereof is indicated in FIG. 1 in simplified form by a first pattern which is visible because for this purpose an edge part, which bears against the roller 10, of the belt 30 has been omitted.

The roller 20 similarly has a structured circumferential surface 23, wherein the structuring is indicated in FIG. 1 in simplified form by a second pattern.

The belt 30 has geometric longitudinal center axis 32 and a cross-section which is bounded by two belt main surfaces 33, 34 and by two belt side surfaces 35, 36 (edges). The belt main surface 33 has a structure which is complementary with the structure of the circumferential surface 13 of the roller 10 and also complementary with the structure of the circumferential surface 23 of the roller 20. By the term "complementary" it should not be said that the structurings of the rollers 10, 20 on the one hand and the belt 30 on the other hand are geometrically exactly complementary when the belt 30 is running straight. The term "complementary" is merely to express that the structurings of the rollers 10, 20 and the belt 30 are so designed that the rollers 10, 20 and the belt 30 are complementary, for the geometric conditions present at the contact regions between the belt 30 and the roller 10 or 20, in such a manner that a satisfactory interaction comes into being.

The belt 30 is, according to the illustrated form of embodiment, twisted about the longitudinal center axis 32 thereof through a twist angle of at least approximately 180° in a region between the rollers 10 and 20. Other forms of embodiment are also possible in which the belt is twisted about the longitudinal center axis 32 thereof through approximately 90°. It is therefore achieved that not only in the case of the roller 10, but also in the case of the roller 20 the structured belt main surface 33 comes into contact or engagement with the structured circumferential surface 13 or 23.

Figure 2B:
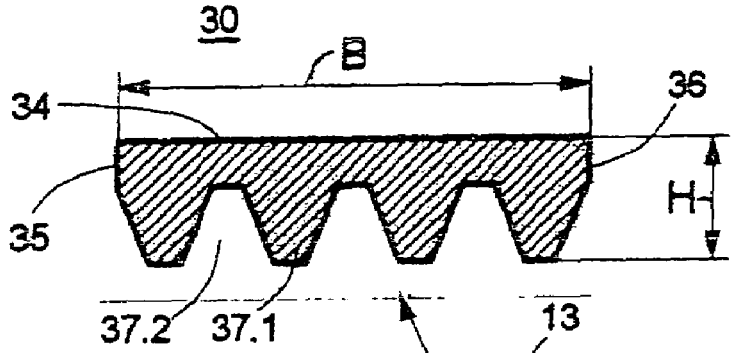
FIG. 2B is a cross-section through the belt of FIG. 1 showing a structured belt main surface matched to the roller illustrated in FIG. 2A.
Figure 2A:
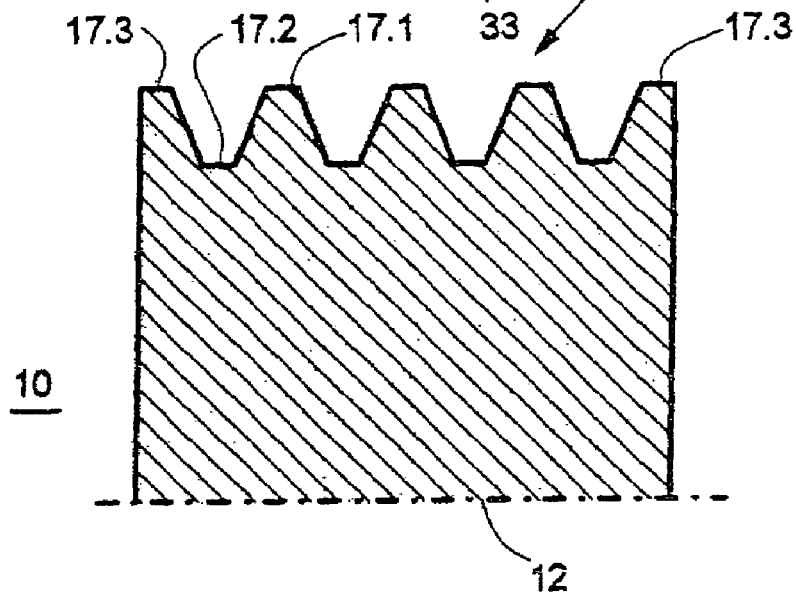
FIG. 2A is a partial cross-section through the upper roller of FIG. 1 showing a structured circumferential surface.

FIG. 2A shows the roller 10 with a structure that is complementary with the structure of the belt according to FIG. 2B. This structure is formed by roller grooves 17.2 and alternating roller ribs 17.1 at the circumferential surface 13 of the roller 10. The roller grooves 17.2 and the roller ribs 17.1 have a trapezoidal shape.

FIG. 2B shows the (longitudinally ribbed) belt 30 in cross-section, having a thickness H, which in the case of use in accordance with the present invention possesses particularly good guidance characteristics. The belt 30 according to FIG. 2A is similar to a wedge belt and has at its main surface 33 a structure that is formed by belt ribs 37.1 extending in a belt longitudinal direction and belt grooves 37.2 lying between the belt ribs 37.1. The belt grooves 37.2 and the belt ribs 37.1 have a trapezoidal shape. The roller 10 is wider in the direction of its axis 12 of rotation than a width B of the belt 30 and has an edge region 17.3 (FIG. 2A) which is not structured. In analogous manner, a cogged belt could also be used instead of the belt 30 similar to a wedge belt.

Figure 3A:
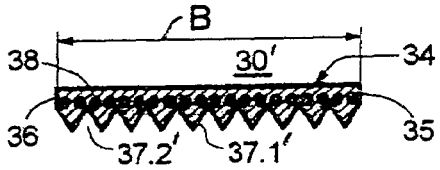
FIG. 3A is a cross-section through a first alternate embodiment belt according to the present invention with a structured belt main surface.

FIG. 3A shows a cross-section of a (longitudinally ribbed) first alternate embodiment belt 30' which here is formed with triangular ribs 37.1' alternating with triangular grooves 37.2'. The belt 30' according to FIG. 3A substantially consists of a suitable flexible material, preferably EPDM (ethylene propylene diene terpolymer) or PU (polyurethane), and has longitudinally extending reinforcing elements 38 (for example, steel wire strands or inserts).

Figure 3B:
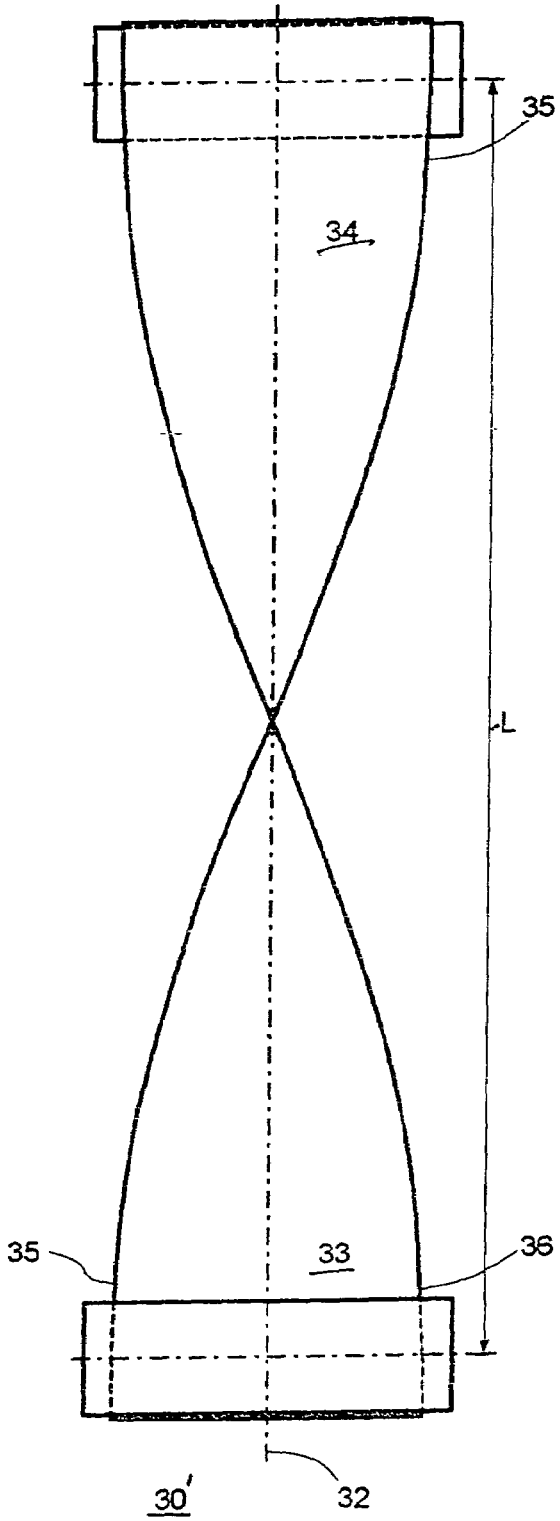
FIG. 3B is a schematic elevation view of the belt illustrated in FIG. 3A with two rollers.

FIG. 3B schematically shows a side view of the belt 30'. In particular, it is apparent from FIG. 3B that the region in which the belt 30' is twisted has a length L. This region is also termed region "A" in the following. Of the belt 30', only the longitudinal axis 32 in this region "A" essentially has the length L. All belt parts laterally spaced from the longitudinal axis 32 are elastically stretched in the region "A" to a length which is greater than L, wherein the belt edge regions 35, 36 are stretched the most.

In that the reinforcing elements 38 are arranged from the longitudinal axis 32 to the belt edge regions 35, 36 either in smaller number or in lower strength, an increased elastic extensibility is imparted to the belt edge regions. Thus, there is a lower elastic deformability in a region along the longitudinal axis 32 than in a vicinity of the opposed edges 35, 36. It is also possible to design the belt edge regions to be extensible in the manner that the cross-section of the actual belt does not remain the same over a belt width B, but changes in adaptation to the loading.

Since the edge regions of the belt 30' as a consequence of the twisting are exposed to increased longitudinal stretching by comparison with the center regions, there can be provided in the edge regions reinforcing inserts, the stress/strain ratio (modulus of elasticity) of which is smaller. In the case of reinforcing inserts in the form of steel wire strands this can be achieved, for example, by different forms of manufacture of the strands (for example, by twisting of different strength).

It may still be mentioned that the length L of the region "A" in which the twisting of the belt 30' takes place is in turn dependent on a spacing L1 of the rollers 10, 20 (see FIG. 1), but that a certain minimum length L or a minimum spacing L1 between the rollers 10, 20 is not to be fallen below. Arrangements in which the spacing L is at least thirty times greater than the width B of the belt are particularly advantageous. According to the present invention arrangements are thus preferred in which the ratio "L/B" is greater than thirty.

Figure 4A:
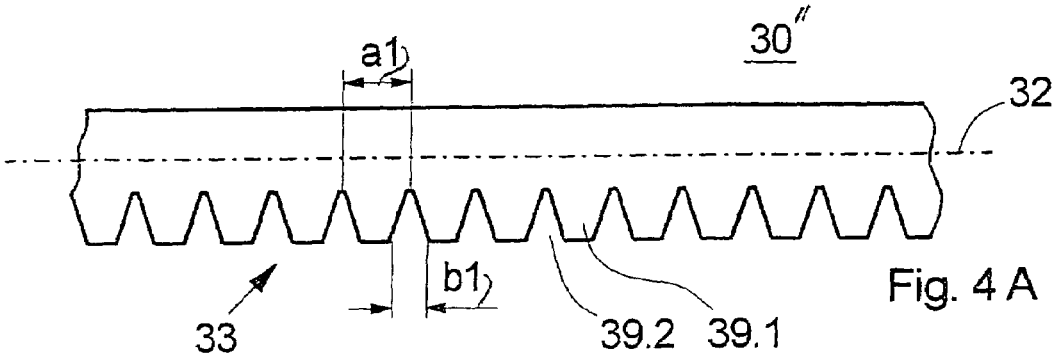
FIG. 4A is fragmentary side elevation view of a second alternate embodiment belt according to the present invention with a structured belt main surface and in a stretched position.
Figure 4B:
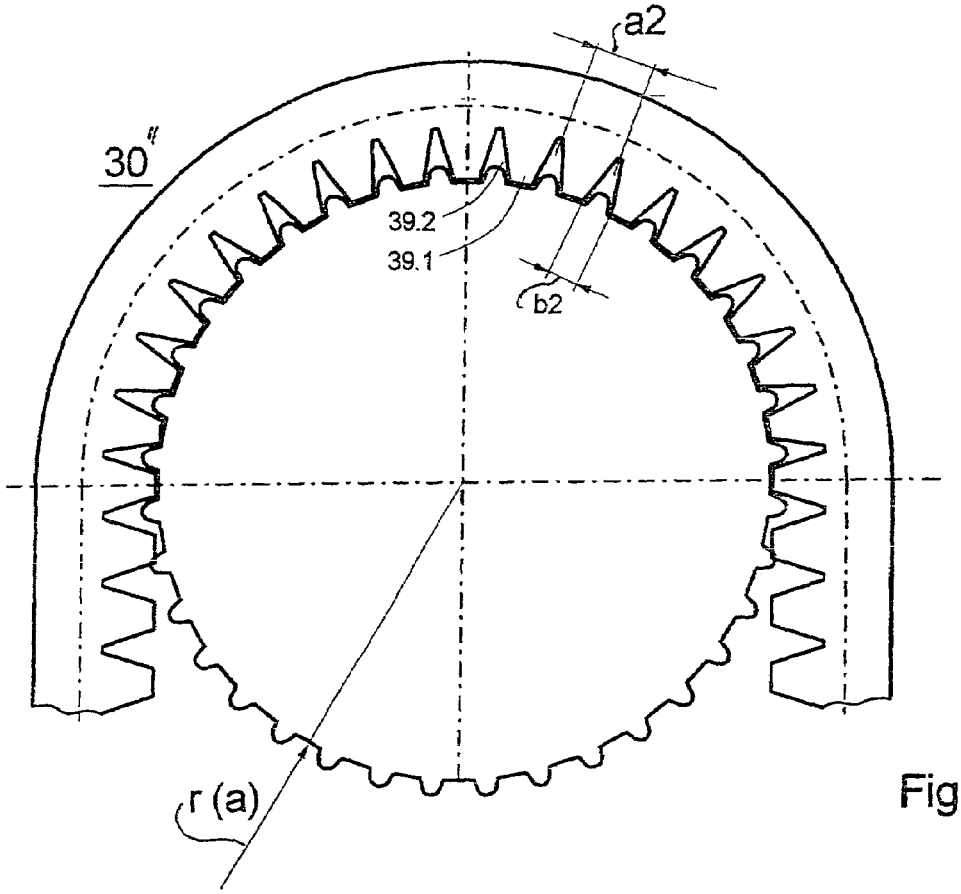
FIG. 4B is a fragmentary side elevation view of the belt illustrated in FIG. 4A in a bent position running around a roller.

A second alternate embodiment belt 30" with a transversely extending toothed structure is illustrated in FIGS. 4A and 4B. This belt 30" has, at its belt main surface 33, belt ribs 39.1 and alternating belt grooves 39.2 which extend at right angles to the longitudinal axis 32. Correspondingly, an associated roller (not illustrated) has a circumferential surface in the form of a gearwheel. Such a belt/roller combination yields particularly good drive characteristics. FIG. 4A shows the belt 30" in stretched or straight arrangement and FIG. 4B shows it in a curved arrangement when it loops around a roller with a roller diameter r(a). According to FIG. 4A, when the belt 30" is stretched the belt rib 39.1 has a width a1 measured to the height of the rib foot and the belt groove 39.2 has a width of b1 measured to the height of the rib crown. According to FIG. 4B when the belt 30" is curved the belt rib 39.1 has a width a2 measured to the height of the rib foot and the belt groove 39.2 has a width b2 measured to the height of the rib crown. As a consequence of the belt bending, the width b2 is smaller than the width b1. Similarly, a2 is smaller than a1 as a consequence of the compressive stresses produced by the belt bending in this belt zone.

Figure 5A:
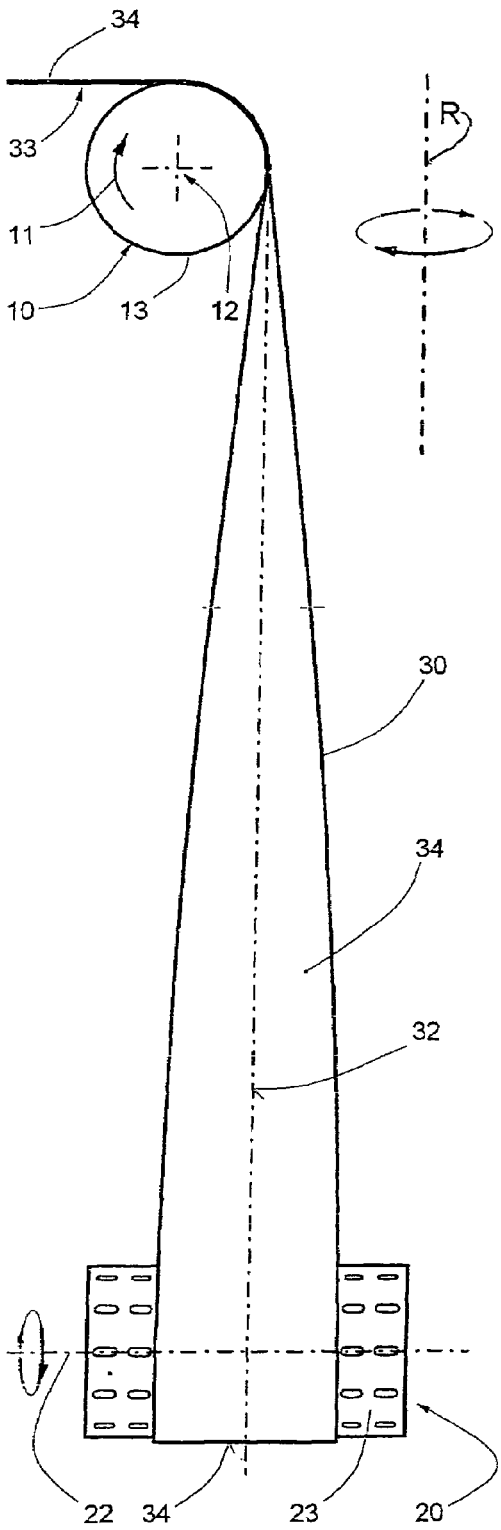
FIG. 5A is an elevation view of a the belt shown in FIG. 1 with the two rollers, the axes of rotation of which intersect at an angle of approximately 90°, and with the belt extending directly therebetween.
Figure 5B:
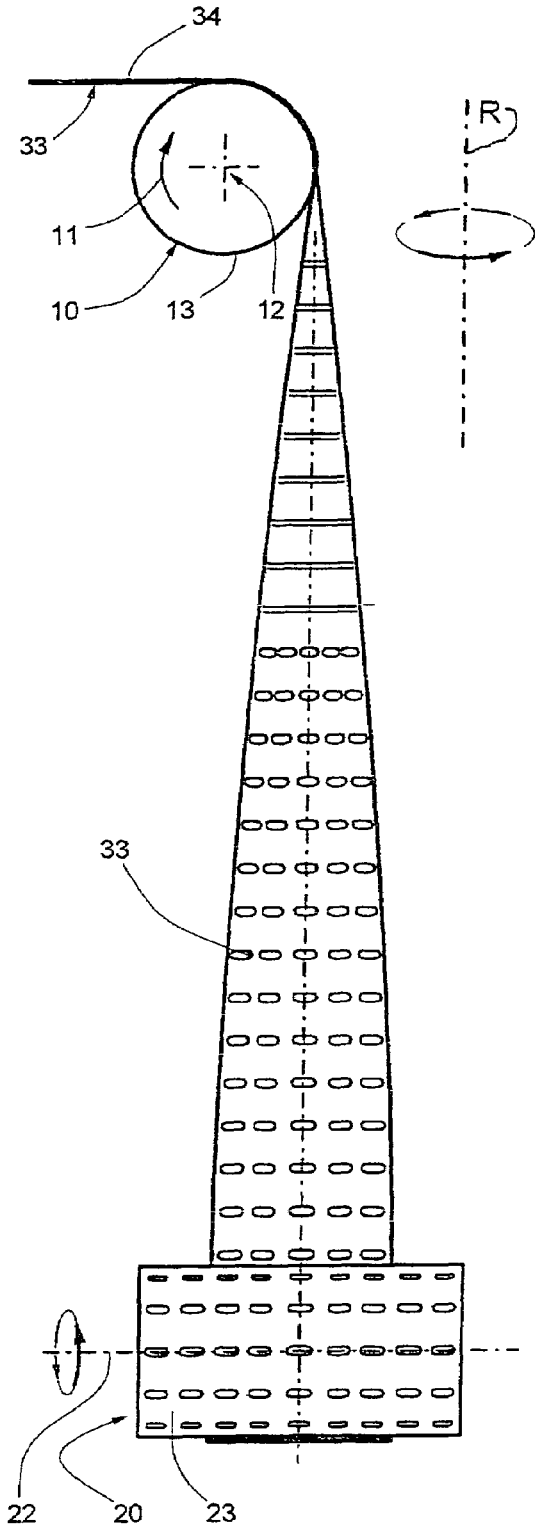
FIG. 5B is a view similar to FIG. 5A with the belt facing in an opposite direction.

FIG. 5A and FIG. 5B show arrangements in which the vertical projection of the axis 22 of the roller 20 and the vertical projection of the axis 12 of the roller 10 intersect and include an angle of 90°. In the case of the arrangement illustrated in FIG. 5A the axis 12 of rotation of the first roller 10 should be rotated about an axis R in order to lie parallel to the axis 22 of the second roller 20. The belt 30 is also twisted in the region between the rollers 10 and 20 through this angle of 90° and in the same direction of rotation. It is thereby achieved that the structured belt main surface 33 is in engagement not only with the structured circumferential surface 13 of the roller 10, but also with the structured circumferential surface 23 of the roller 20.

In the case of the arrangement illustrated in FIG. 5B the roller 20 rotates oppositely to the roller 20 shown in FIG. 5A. Correspondingly, the belt 30 is rotated, in the region between the rollers 10 and 20, in reverse direction to the belt 30 shown in FIG. 5A. It is also achieved in the case of the arrangement illustrated in FIG. 5B that the structured belt main surface 33 is in engagement not only with the structured circumferential surface 13 of the roller 10, but also with the structured circumferential surface 23 of the roller 20.

Figure 6:
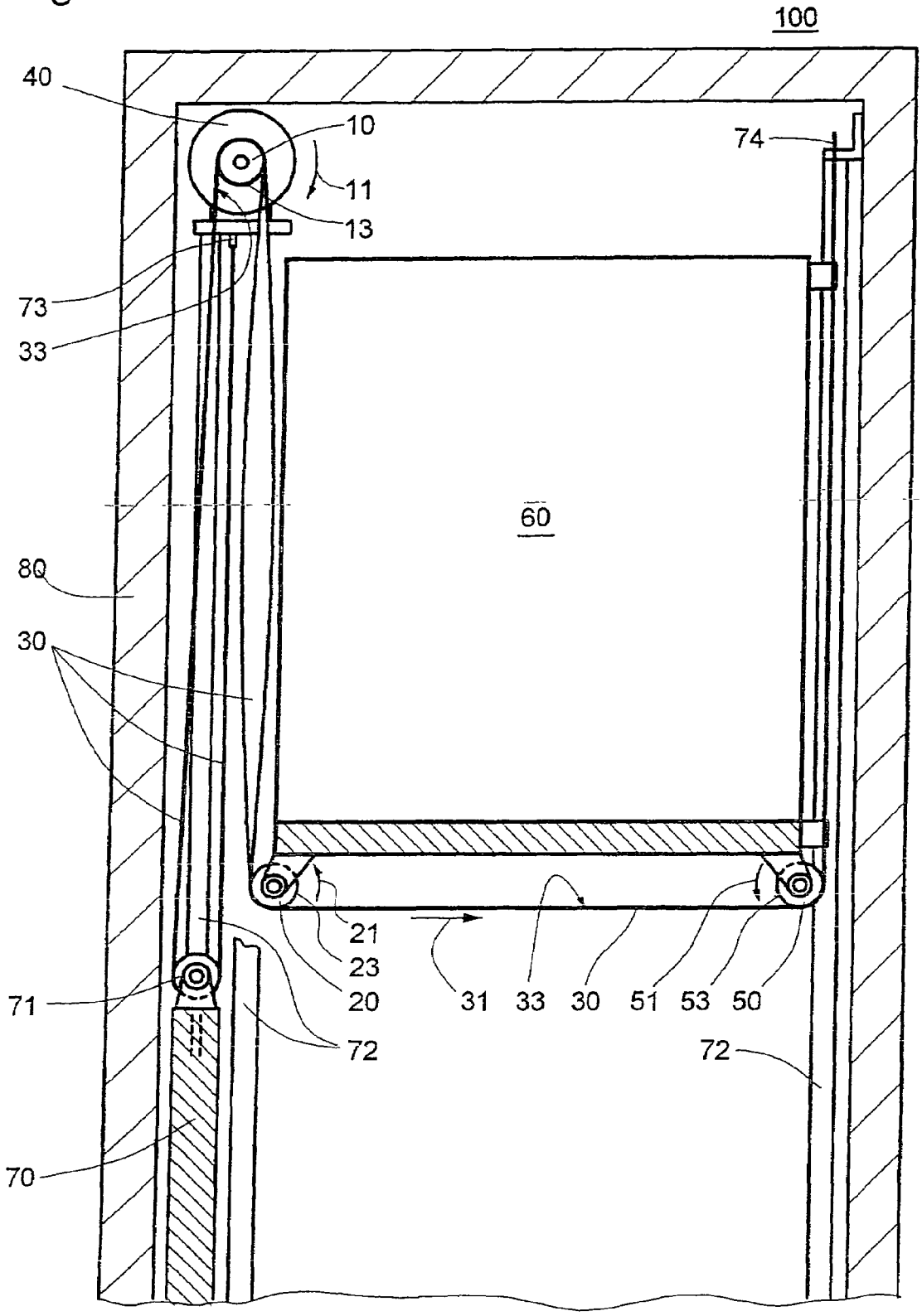
FIG. 6 is a schematic cross-sectional view of an elevator system including the belt according to the present invention.

FIG. 6 shows an elevator installation 100 according to the present invention, with a drive unit 40, the first roller 10, which forms a drive pulley, the second roller 20, which forms a support/deflecting roller, a further roller 50, the belt 30 and an elevator car 60. In the case of movement of the elevator car 60, in which the belt 30 moves in the direction of the arrow 31, the roller 10 rotates according to the arrow 11, the roller 20 rotates in opposite sense to the roller 10 in accordance with the arrow 21 and the roller 50 rotates in the same sense according an arrow 51 as the roller 20. The belt 30 is twisted through at least approximately 180° between the first roller 10 and the second roller 20, whereas it is not twisted between the second roller 20 and the third roller 50. The structured belt surface 33 thereby always stands in contact with the circumferential surfaces 13, 23 and 53 of, respectively, the rollers 10, 20 and 50.

In addition to the stated elements, the elevator installation 100 comprises an elevator shaft 80, vertical guide rails 72, a counterweight 70 and a roller 71. The belt 30 is connected at a point 73 with one of the vertical guide rails 72 of the elevator installation 100 and runs around the counterweight support roller 71. The other end of the belt 30 is fastened in the region 74 of the upper end of the second vertical guide rail 72. Thus, the belt 30 and the rollers 20, 50 provide an under-looping support for the elevator car 60.

The structure of the belt 30 and the structures of the rollers 10 and 20 are complementary in an optimum manner when either the diameters and also the structures of the rollers 10 and 20 are the same or when the diameters of the rollers are different and then correspondingly also their structures are different. It is, however, obvious that not only the geometry, but also the material characteristics of the belt 30 establish a lower limit for the roller diameter which may not be fallen below.

Suitable widths B and thicknesses H of the belt 30, suitable looping angles $\gamma 1$, $\gamma 2$ (see FIG. 1), suitable diameters r of the rollers 10, 20, suitable radii of curvature for the belt and suitable spacings L1 between the rollers 10, 20 were ascertained partly by computer, but partly also by experiments.

Suitable belts 30 preferably have a width/thickness ratio (B/H) which is smaller than or equal to ten, i.e., for example, a width B of five centimeters and correspondingly a thickness H of 0.5 centimeters.

Suitable looping angles γ1, γ2 lie between 60° and 180°. Preferably these lie between 90° and 180°.

Suitable roller diameters r amount to between six centimeters and twenty centimeters.

The spacing L1 between the two directly successive rollers 10 and 20 should amount to at least one hundred centimeters. The spacing L1 preferably lies between one hundred centimeters and three hundred centimeters. Tests have shown that in the interests of the perfect belt running and sufficient service life the ratio between the spacing L1 and the width B of a belt twisted about the longitudinal axis thereof by 180° should not fall below a value of thirty and should preferably lie in the region of fifty. For smaller twist angles, these values can be proportionally reduced. Suitable rubbers and elastomers (plastic materials), particularly polyurethane (PU) and ethylene propylene copolymer (EDPM), can be used as material for the belt 30 with a structured belt main surface 33, which is suitable for use in the elevator system 100. In a given case the belt 30 can also be furnished with the reinforcing inserts 38 oriented in the longitudinal direction of the belt and/or with mesh-like reinforcing inserts. Twisted steel wire threads are, for example, suitable as the reinforcing inserts 38 oriented in the longitudinal direction of the belt. In order to impart a higher degree of elasticity to the belt in the edge regions 35, 36, the strands 38 can, for example, be more strongly twisted in the edge region than the strands in the center region of the belt 30. A smaller stress/strain ratio results therefrom for the strands in the edge region of the belt, so that in the case of a loaded belt twisted about the longitudinal axis thereof approximately the same tension stresses result in the wires of the central strands and outer strands.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator system comprising:

an elevator car;

a roller arrangement including at least two rollers having structured circumferential surfaces; and at least one belt having a longitudinal axis, said one belt extending directly between a first one of said rollers and a second one of said rollers, said one belt having a structured belt main surface formed complementary to said structured circumferential surfaces of said first and second rollers, said first roller being rotatable about a first axis of rotation and said second roller being rotatable about a second axis of rotation, said one belt being twisted about said longitudinal axis in a region between said first and second rollers such that said structured belt main surface engages with said structured circumferential surfaces of said first and second rollers.

2. The elevator system according to claim 1 wherein said structured belt main surface and said structured circumferential surfaces are formed as alternating ribs and grooves, said ribs of said one belt engaging corresponding ones of said grooves of said first and second rollers and said ribs of said first and second rollers engaging corresponding ones of said grooves of said one belt.

3. The elevator system according to claim 2 wherein said ribs and said grooves of said one belt and said ribs and said grooves of said first and second rollers extend parallel to said longitudinal axis of said one belt to improve guidance characteristics between said first and second rollers and said one belt.

4. The elevator system according to claim 2 wherein said ribs and said grooves of said one belt and said ribs and said grooves of said first and second rollers have trapezoidal cross-sections.

5. The elevator system according to claim 2 wherein said ribs and said grooves of said one belt and said ribs and said grooves of said first and second rollers have triangular cross-sections.

6. The elevator system according to claim 2 wherein said ribs and said grooves of said one belt and said ribs and said grooves of said first and second rollers extend transversely to said longitudinal axis of said one belt to improve at least one of bending capability and traction capability between said first and second rollers and said one belt.

7. Elevator system according to claim 1 wherein said one belt has a lower elastic deformability in a region along said longitudinal axis than in a vicinity of opposed edges.

8. The elevator system according to claim 1 wherein said one belt includes reinforcing elements oriented along said longitudinal axis wherein said one belt has increased elastic extensibility in edge regions of said one belt.

9. The elevator system according to claim 1 wherein said one belt is twisted in said region through an angle in a range of 70° to 200°.

10. The elevator system according to claim 1 wherein said one belt is twisted in said region through an angle in one of a range of 70° to 110° and a range of 160° to 200°.

11. The elevator system according to claim 1 wherein said one belt has a width B and spacing L in said region, L being greater than thirty times B for a twist angle of approximately 180° and L being greater than fifteen times B for a twist angle of approximately 90°.

12. The elevator system according to claim 1 wherein said first roller is a drive pulley and said second roller is one of a deflecting pulley and a supporting pulley.

13. An elevator system comprising:

an elevator car;

a drive unit;

a first roller having a structured circumferential surface and being driven in rotation by said drive unit;

a second roller having a structured circumferential surface and being rotatably mounted on said elevator; and at least one belt having a longitudinal axis, said one belt extending directly between said first and second rollers, said one belt having a structured belt main surface formed complementary to said structured circumferential surfaces of said first and second rollers, said one belt being twisted about said longitudinal axis in a region between said first and second rollers such that said structured belt main surface engages with said structured circumferential surfaces of said first and second rollers.

14. The elevator system according to claim 13 including a third roller rotatably mounted on said elevator car, said second and third rollers directing said one belt underneath said elevator car to provide an under-looping support.

15. The elevator system according to claim 13 wherein said structured belt main surface and said structured circumferential surfaces are formed as alternating ribs and grooves, said ribs of said one belt engaging corresponding ones of said grooves of said first and second rollers and said ribs of said first and second rollers engaging corresponding ones of said grooves of said one belt.

* * * * *